US006766558B1

(12) United States Patent
Matsumoto et al.

(10) Patent No.: US 6,766,558 B1
(45) Date of Patent: Jul. 27, 2004

(54) VACUUM CLEANER

(75) Inventors: Yukimichi Matsumoto, Osaka (JP); Hiroshi Ota, Osaka (JP); Teruhisa Inoue, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 265 days.

(21) Appl. No.: 10/031,383

(22) PCT Filed: Jul. 17, 2000

(86) PCT No.: PCT/JP00/04804

§ 371 (c)(1),
(2), (4) Date: Jan. 18, 2002

(87) PCT Pub. No.: WO01/05291

PCT Pub. Date: Jan. 25, 2001

(30) Foreign Application Priority Data

Jul. 19, 1999 (JP) ..... 11-204524

(51) Int. Cl.[7] ..... A47L 9/16; A47L 5/36

(52) U.S. Cl. ..... 15/353; 15/327.1; 15/347

(58) Field of Search ..... 15/347, 350, 351, 15/352, 353, 377, 327.1; 55/337, 459.1, 429, DIG. 5

(56) References Cited

U.S. PATENT DOCUMENTS

| | | | | |
|---|---|---|---|---|
| 2,542,635 A | * | 2/1951 | Davis et al. | 55/399 |
| 4,172,710 A | | 10/1979 | van der Molen | |
| 5,078,761 A | | 1/1992 | Dyson | |
| 6,026,540 A | * | 2/2000 | Wright et al. | 15/347 |
| 6,146,434 A | * | 11/2000 | Scalfani et al. | 55/334 |
| 6,436,160 B1 | * | 8/2002 | Stephens et al. | 55/337 |
| 6,558,453 B2 | * | 5/2003 | Sepke et al. | 95/268 |

FOREIGN PATENT DOCUMENTS

| | | |
|---|---|---|
| CN | 1179935 A | 4/1998 |
| DE | 1 407 995 | 2/1969 |
| EP | 1136028 A2 | 9/2001 |
| JP | 43-24793 Y | 10/1968 |
| JP | 43-29416 Y | 12/1968 |
| JP | 48-54260 U | 7/1973 |
| JP | 49-20966 U | 2/1974 |
| JP | 52-34571 U | 3/1977 |
| JP | 54-6292 | 3/1979 |
| JP | 54-60953 U | 4/1979 |
| JP | 54-60953 | 4/1979 |
| JP | 55-95642 U | 7/1980 |
| JP | 55-47163 | 11/1980 |
| JP | 55-47163 B2 | 11/1980 |
| JP | 59-29628 Y2 | 8/1984 |
| JP | 59-37163 Y2 | 10/1984 |
| JP | 59-165148 U | 11/1984 |
| JP | 60-7637 Y2 | 3/1985 |
| JP | 3-65545 U | 6/1991 |
| JP | 4-164423 A | 6/1992 |
| JP | 10-85159 A | 4/1998 |
| JP | 2583345 Y2 | 8/1998 |
| JP | 2000-135183 A | 5/2000 |
| JP | 2000-139790 A | 5/2000 |
| JP | 2000-166829 A | 6/2000 |
| WO | 00/74548 A1 | 12/2000 |
| WO | WO01/07168 A1 | 2/2001 |

* cited by examiner

*Primary Examiner*—Terrence R. Till
(74) *Attorney, Agent, or Firm*—Birch, Stewart, Kolasch & Birch, LLP

(57) ABSTRACT

A vacuum cleaning including a suction port body having a suction port, an electric blower generating suction air, a connection pipe connected to the suction port body, and a cyclone type dust collecting part which is disposed between the suction port body and the electric blower and exhausts suction air from an exhaust port after the suction air added from a flow-in port is swirled so as to separate dust and dirt, wherein a first dust collecting chamber and a second dust collecting chamber storing the separated dust and dirt are provided coaxially with each other through a partition wall having an opening part, whereby a cyclone dust collecting part can be reduced in size, the controllability for refuse disposal can be increased, and the electric blower can be prevented from being damaged.

18 Claims, 15 Drawing Sheets

VACUUM CLEANER

This application is the national phase under 35 U.S.C. § 371 of PCT International Application No. PCT/JP00/04804 which has an International filing date of Jul. 17, 2000, which designated the United States of America.

TECHNICAL FIELD

The present invention relates to a vacuum cleaner having a cyclone dust collecting part that separates dust and dirt by forming suction air into a whirling stream.

BACKGROUND ART

Conventional examples of vacuum cleaners having a cyclone dust collecting part that separates dust and dirt (hereinafter simply "dust") by forming suction air into a whirling stream are disclosed in Japanese Utility Model Registered No. 2583345 and Japanese Patent Application Laid-Open No. H10-85159. According to these publications, a connection pipe that is connected, at one end, to a suction port body having a suction port is coupled, at the other end, to a cyclone dust collecting part. The cyclone dust collecting part communicates, through a suction hose, with the body of the vacuum cleaner.

FIG. 26 shows a sectional view, as seen from the side, of the cyclone dust collecting part, and FIG. 27 shows a sectional view taken along line A—A shown in FIG. 26. The suction air produced by an electric blower passes through a connection pipe 50 and flows into the cyclone dust collecting part 51 through a flow-in port 51*a*. The suction air, as it passes through a helical passage 51*b* formed inside the cyclone dust collecting part 51, is formed into a whirling stream. As the suction air swirls, under centrifugal force, the dust contained therein collides with a wall surface 53*a* of an inner cylinder part 53, with the result that the dust falls, along a conical part 53*c* provided in the inner cylinder part 53, into a dust collecting chamber 55.

The suction air having dust separated therefrom is exhausted through an exhaust port 51*c* and is fed to a body (not shown) of the vacuum cleaner. In this way, the dust collecting chamber 55 for accommodating dust is provided in the cyclone dust collecting part 51, which is integral with the connection pipe 50. This helps miniaturize the vacuum cleaner and enhance the operability thereof.

However, in the conventional vacuum cleaner described above, the suction passage that runs from the helical passage 51*b* through the exhaust port 51*c* is separated from the dust collecting chamber 55 by the conical part 53*c*. As a result, the dust collecting chamber 55 arranged below the conical part 53*c* and the suction passage make the cyclone dust collecting part 51 unduly large, spoiling the operability of the vacuum cleaner when the aforementioned suction port body thereof is moved around.

Moreover, inside the dust collecting chamber 55, fine and coarse particles of dust are collected in a mixed manner. This leads to problems like, when the dust collected in the dust collecting chamber 55 is disposed of, fine particles thereof rising into the air and making the surroundings dirty, and such fine particles of dust evading through the exhaust port 51*c* and damaging the electric blower.

These problems can be solved by providing a dust container inside the body of the vacuum cleaner and permitting fine particles of dust to evade through the exhaust port 51*c* so that they are filtered out by the dust container. However, this method requires that the body of the vacuum cleaner be made larger, and in addition requires that the refuse collected in the dust container be disposed of, which spoils the operability of the vacuum cleaner when the refuse is disposed of.

DISCLOSURE OF THE INVENTION

An object of the present invention is to provide a vacuum cleaner that has a miniaturized cyclone dust collecting part but that nevertheless offers improved operability when refuse is disposed of and that is less prone to failure in the electric blower thereof.

To achieve the above object, according to the present invention, a vacuum cleaner is provided with a suction port body having a suction port, an electric blower for generating suction air, a connection pipe connected to the suction port body, and a cyclone type dust collecting part, disposed between the suction port body and the electric blower, for forming the introduced suction air into a whirling stream so as to separate dust. Here, a dust collecting chamber for accommodating the separated dust is provided within a suction air passage of the cyclone type dust collecting part.

In this structure, the suction air produced by the electric blower and introduced through a flow-in port flows through the connection pipe into the cyclone type dust collecting part. Inside the cyclone type dust collecting part, as the suction air flows in the form of a whirling stream, dust is separated therefrom, and the dust is accommodated in the dust collecting chamber. The suction air having dust separated therefrom passes through the dust collecting chamber, and is then exhausted by being sucked by the electric blower.

Alternatively, according to the present invention, a vacuum cleaner is provided with a suction port body having a suction port an electric blower for generating suction air, a connection pipe connected to the suction port body, and a cyclone type dust collecting part, disposed between the suction port body and the electric blower, for forming the suction air introduced through a flow-in port into a whirling stream so as to separate dust and then discharging the suction air through an exhaust port. Here, a first dust collecting chamber and a second dust collecting chamber for accommodating the separated dust are provided in the cyclone type dust collecting part. The first and second dust collecting chambers are separated from each other by a partition wall having an opening part formed therein.

In this structure, the suction air produced by the electric blower and introduced through the flow-in port flows through the connection pipe into the cyclone type dust collecting part. Inside the cyclone type dust collecting part, as the suction air flows in the form of a whirling stream, dust is separated therefrom. Larger particles of the dust are blocked by the partition wall and are accommodated in the first dust collecting chamber; smaller particles of the dust are permitted through through holes and are accommodated in the second dust collecting chamber. The suction air having dust separated therefrom is exhausted by being sucked by the electric blower.

According to the present invention, in the vacuum cleaner structured as described above, it is possible to arrange the first dust collecting chamber within the suction air passage of the cyclone type dust collecting part and the second dust collecting chamber outside the suction air passage of the cyclone type dust collecting part. In this structure, the suction air having dust separated therefrom passes through the first dust collecting chamber and is then exhausted by being sucked by the electric blower. Meanwhile, the dust collected in the second dust collecting chamber is prevented from being mixed with the suction air again and exhausted together through the exhaust port.

According to the present invention, in the vacuum cleaner structured as described above, the first and second dust collecting chambers may be arranged so as to be detachable from the cyclone type dust collecting part. In this structure, refuse is disposed of with the first and second dust collecting chambers detached from the cyclone type dust collecting part.

According to the present invention, in the vacuum cleaner structured as described above, at least part of the first and second dust collecting chambers may be formed out of a transparent member that permits an inside to be viewed from outside. In this structure, the amount of dust collected in the first and second dust collecting chambers can be visually checked from outside.

According to the present invention, in the vacuum cleaner structured as described above, a valve for closing the flow-in port when the electric blower is at rest may be provided. In this structure, even when the electric blower is at rest, backflow of the collected dust is prevented.

According to the present invention, in the vacuum cleaner structured as described above, the exhaust port may be provided in the cylindrical surface of an inner cylinder that is slidable inside an outer cylinder that is provided so as to protrude into the first dust collecting chamber so that, when the exhaust port is clogged, the exhaust port is covered by the outer cylinder under the suction force of the electric blower. In this structure, when the exhaust port is clogged, the inner cylinder is sucked into the outer cylinder under vacuum pressure, so that the exhaust port is covered by the outer cylinder.

According to the present invention, in the vacuum cleaner structured as described above, a pressure sensor for detecting the pressure difference between in the suction air passage of the cyclone type dust collecting part and in the exhaust passage for the suction air exhausted through the exhaust port may be provided. In this structure, when the pressure difference between on the upstream and downstream sides of the exhaust port reaches a predetermined level, the exhaust port is detected being clogged.

According to the present invention, in the vacuum cleaner structured as described above, the cyclone type dust collecting part may be arranged substantially parallel to the connection pipe and on the side of the connection pipe opposite to the floor surface, with the opening part provided away from the connection pipe.

According to the present invention, in the vacuum cleaner structured as described above, the cyclone type dust collecting part may be arranged substantially parallel to the connection pipe, with part of the connection pipe bent so as to form a handle part to be held by a user during cleaning

BEST MODE FOR CARRYING OUT THE INVENTION

Figure 1:
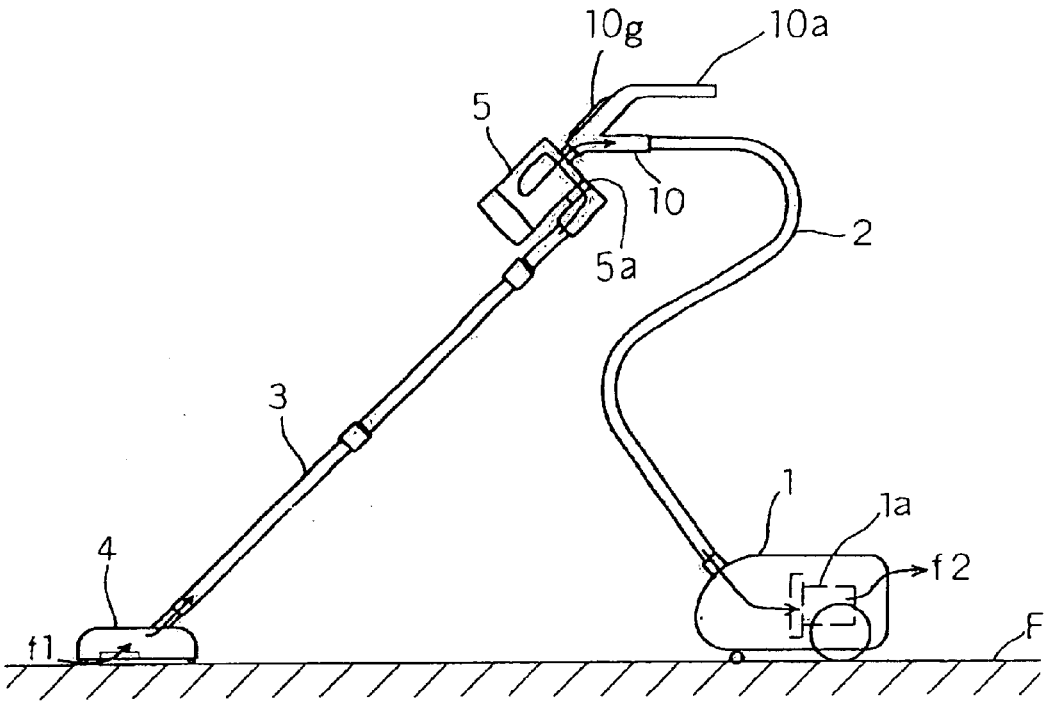
FIG. 1 is a diagram schematically showing the vacuum cleaner of a first embodiment of the invention.

Hereinafter, embodiments of the present invention will be described with reference to the drawings. FIG. 1 is a diagram schematically showing the vacuum cleaner of a first embodiment. To a suction port body 4 having a suction port (not shown) facing the floor surface F, a connection pipe 3 is connected, which is coupled to a cyclone dust collecting part 5.

The cyclone dust collecting part 5 communicates, through a coupling member 10 and a suction hose 2, with a body 1 of the vacuum cleaner having an electric blower 1*a*. Part of the coupling member 10 is bent so as to form a handle 10*a* to be held by the user. On the handle 10*a* is provided an operation part 10*g*, which has operation keys for various operations and a display for indicating the operation status.

When the electric blower 1*a* is driven, suction air is taken in through the suction port of the suction port body 4 as indicated by arrow f1. The suction air passes through the connection pipe 3 and flows into the cyclone dust collecting part 5 through an flow-in port 5*a*. Inside the cyclone dust collecting part 5, as the suction air flows in the form of a whiling stream, dust is separated and removed therefrom. The suction air is then discharged out of the body 1 of the vacuum cleaner by the suction force of the electric blower 1*a* as indicated by arrow f2.

Figure 2:
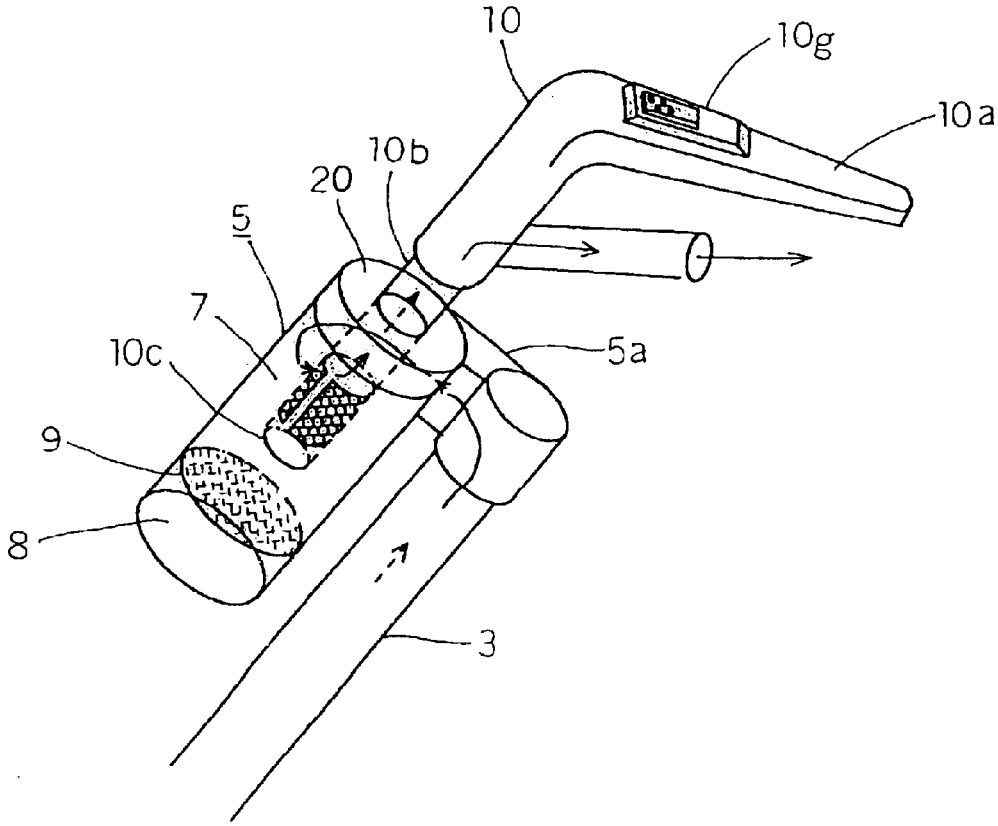
FIG. 2 is a perspective view of the cyclone dust collecting part of the vacuum cleaner of the first embodiment of the invention.
Figure 3:
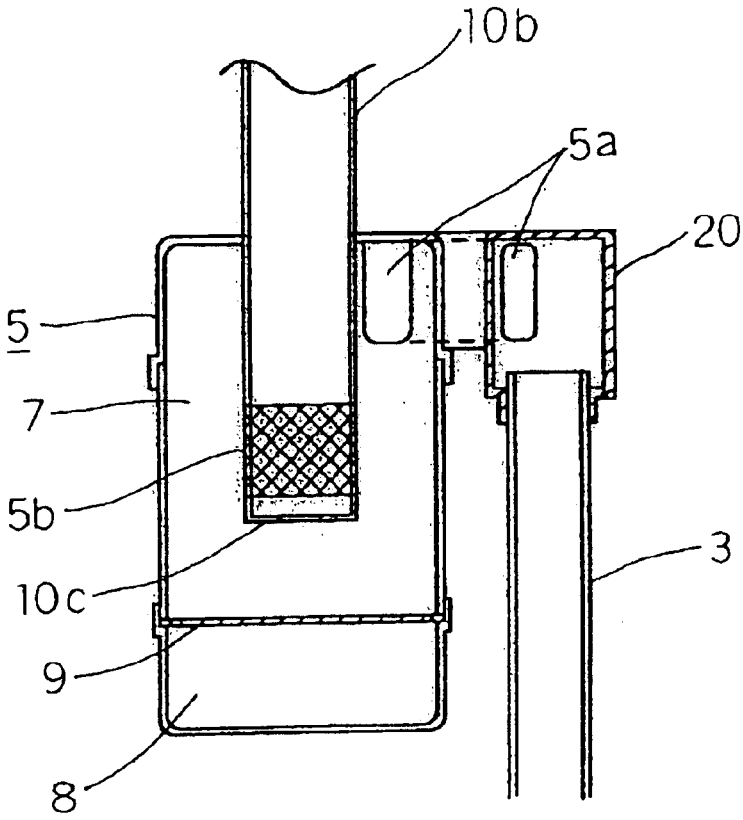
FIG. 3 is a sectional view, as seen from the side, of the cyclone dust collecting part of the vacuum cleaner of the first embodiment of the invention.
Figure 4:
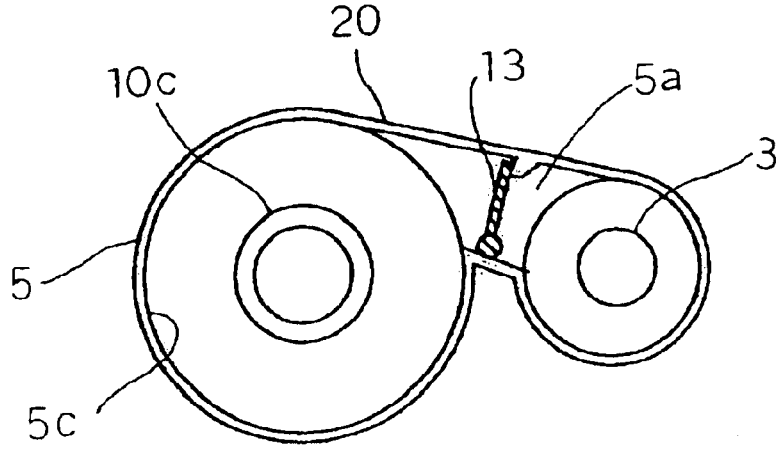
FIG. 4 is a sectional view, as seen from above, of the cyclone dust collecting part of the vacuum cleaner of the first embodiment of the invention.

The details of the cyclone dust collecting part 5 are shown in a perspective view in FIG. 2, a sectional view as seen from the side in FIG. 3, and a sectional view as seen from above in FIG. 4. The cyclone dust collecting part 5 has, in a top portion thereof, a suction air guide 20, in which the flow-in port 5*a* is formed. Thus, the cyclone dust collecting part 5 is coupled through the suction air guide 20 to the connection pipe 3. The cyclone dust collecting part 5 is formed substantially in a cylindrical shape, and is arranged parallel to the connection pipe 3. The flow of the suction air flowing into the cyclone dust collecting part 5 through the flow-in port 5*a* is substantially perpendicular to the flow of the suction air exhausted from the cyclone dust collecting part 5.

Moreover, the cyclone dust collecting part 5 is arranged on the side of the connection pipe 3 opposite to the floor surface F (see FIG. 1). This makes it possible to lean the connection pipe 3 into a position in which it lies flat on the floor surface F when a narrow space such as the gap under a bed is cleaned, and in addition prevents the cyclone dust collecting part 5 from breaking and spreading dust about even when the cyclone dust collecting part 5 is dropped.

Figure 5:
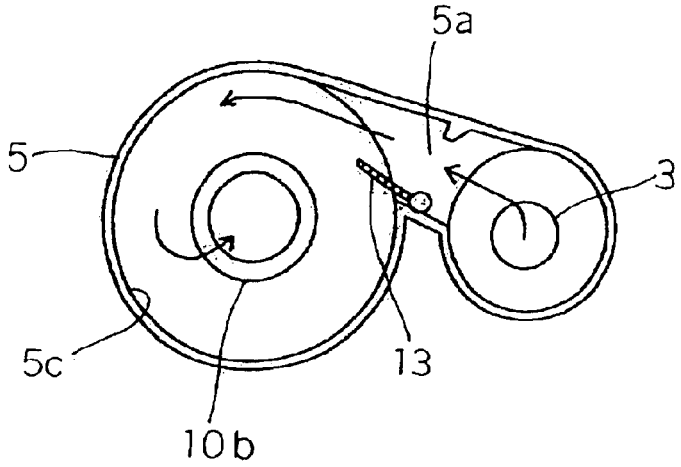
FIG. 5 is a sectional view, as seen from above, of the cyclone dust collecting part of the vacuum cleaner of the first embodiment of the invention, showing its state with the valve open.

The suction air guide 20 is provided with a valve 13 made of an elastic material such as rubber. Under the vacuum pressure of the suction air, the valve 13 bends in the direction of the flow of the suction air. Thus, as shown in FIG. 5, the suction air flows into the cyclone dust collecting part 5 through the flow-in port 5*a* tangentially to the cyclone dust collecting part 5. As a result, as the suction air collides with an inner wall 5*c* of the cyclone dust collecting part 5 and is thereby formed into a whirling stream dust is separated from the suction air and is collected in a first dust collecting chamber 7.

When the suction air is not flowing, the valve 13, by its own elasticity, closes the flow-in port 5*a*, and thereby prevents backflow of the dust. In this way, the dust collected is prevented from flowing back when, for example, the vacuum cleaner is stored away. The valve 13 may be formed out of a hard, plate-shaped member, in which case the valve 13 is loaded with a force that tends to cause it to close the flow-in port 5*a* by an elastic member such as a spring.

Figure 6:
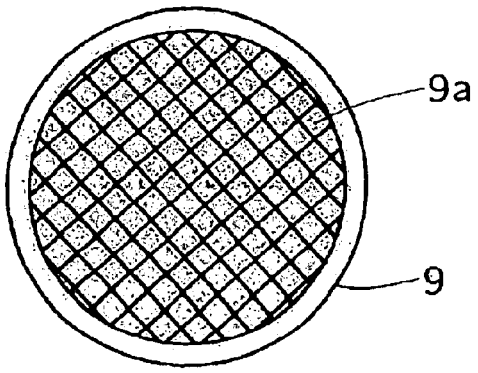
FIG. 6 is a diagram showing an example of the structure of the partition wall of the cyclone dust collecting part of the vacuum cleaner of the first embodiment of the invention.

Under the first dust collecting chamber 7 is provided a second dust collecting chamber 8 substantially coaxially therewith, with a partition wall 9 placed in between. The partition wall 9 has a meshed opening part 9*a* having a large number of through holes as shown in FIG. 6. The mesh is formed out of a resin such as a nylon-based resin or a metal formed into a net, and is fixed to the partition wall 9 by double molding, by heat fusion, or with adhesive.

Fine particles of dust pass through the opening part 9*a* and are collected in the second dust collecting chamber 8. The opening part 9*a* may be formed by molding the partition wall 9 in the shape of a grid, or by forming a large number of through holes therethrough that penetrate between the first and second dust collecting chambers 7 and 8.

Figure 7:
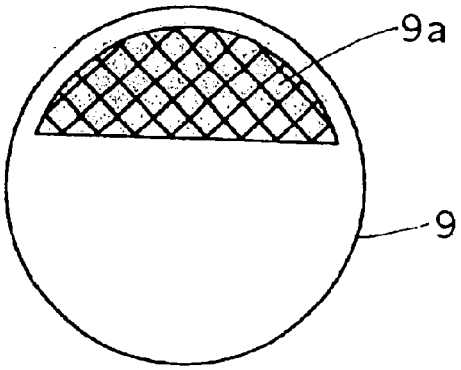
FIG. 7 is a diagram showing another example of the structure of the partition wall of the cyclone dust collecting part of the vacuum cleaner of the first embodiment of the invention.
Figure 8:
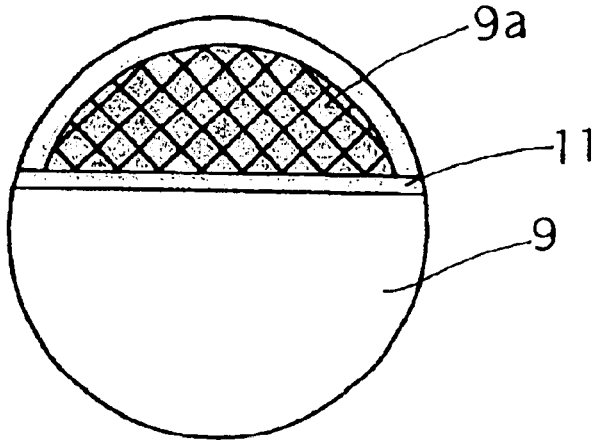
FIG. 8 is a diagram showing still another example of the structure of the partition wall of the cyclone dust collecting part of the vacuum cleaner of the first embodiment of the invention.
Figure 9:
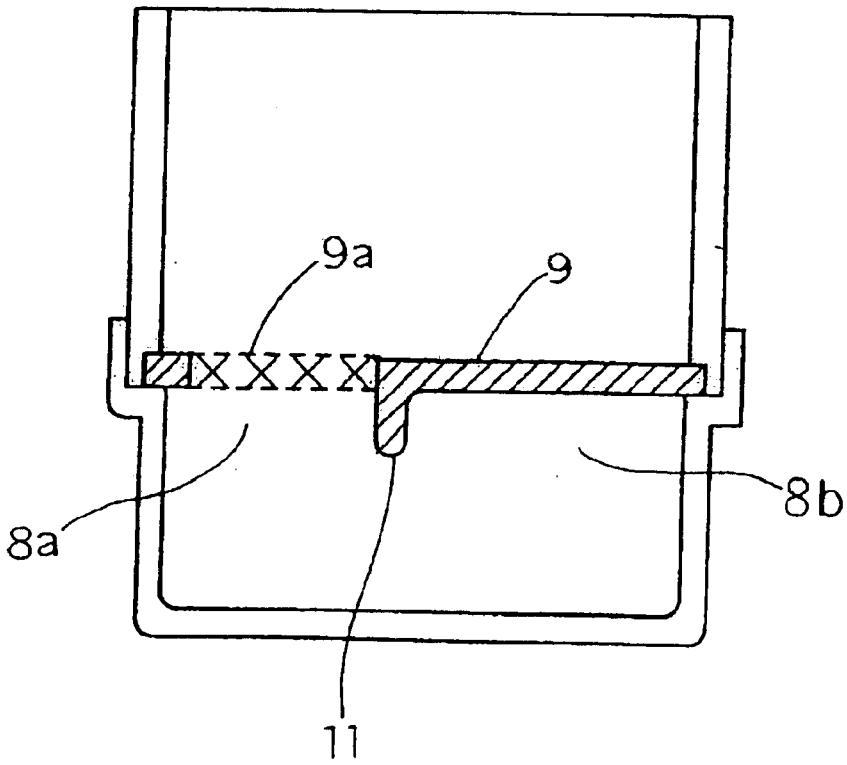
FIG. 9 is a sectional view, as seen from the side, of the partition wall shown in FIG. 8.

As shown in FIG. 7, the opening part 9*a* may be provided in part of the partition wall 9. As shown in FIGS. 8 and 9, a rib 11 having an adequate length may be formed so as to divide the second dust collecting chamber 8 into a portion 8*a* where the opening part 9*a* is provided and a portion 8*b* where the opening part 9*a* is not provided. This is preferable because it prevents backflow of the dust that has entered, over the rib 11, the portion 8*b* where the opening part 9*a* is not provided.

Figure 10:
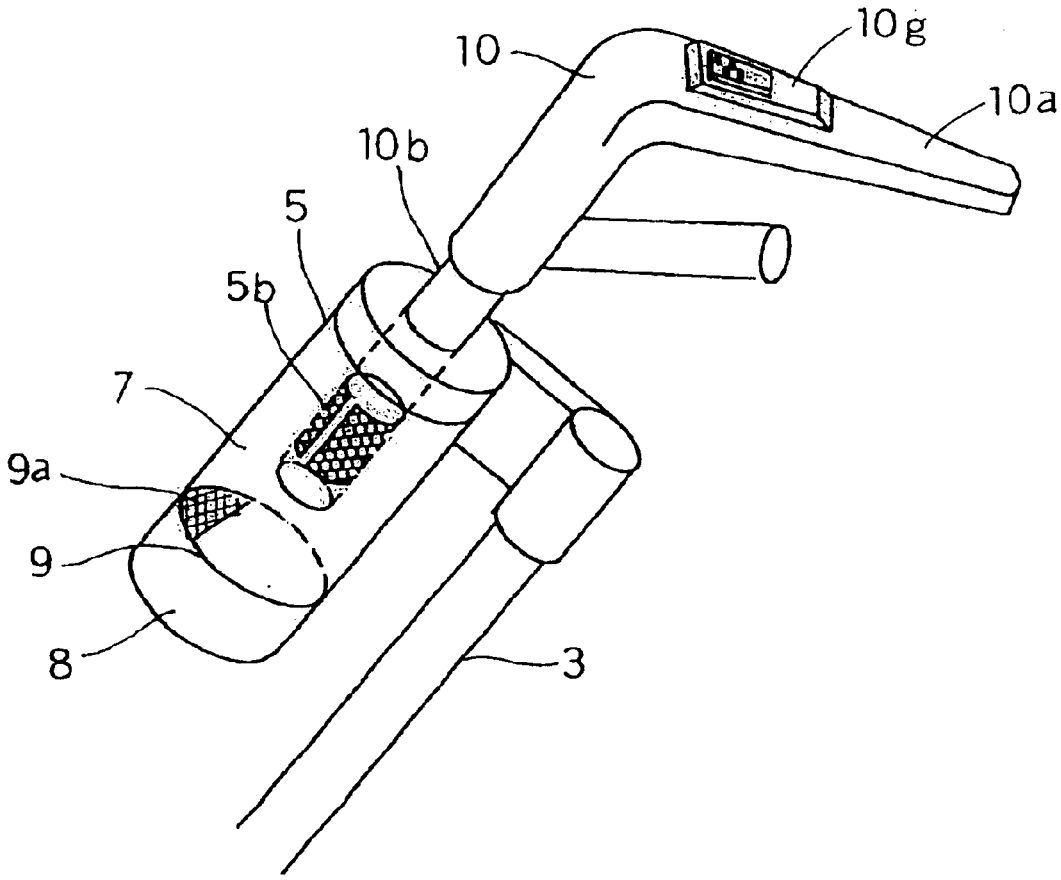
FIG. 10 is a diagram illustrating the direction in which the cyclone dust collecting part is fitted in the vacuum cleaner of the first embodiment of the invention.

When the opening part 9*a* is formed in part of the partition wall 9 as shown in FIGS. 7 and 8, it is preferable to arrange the opening part 9*a* away from the connection pipe 3 as shown in FIG. 10, because this prevents backflow of the dust collected in the second dust collecting chamber 8 when a high position such as the surface of a wall is cleaned.

Figure 11A:
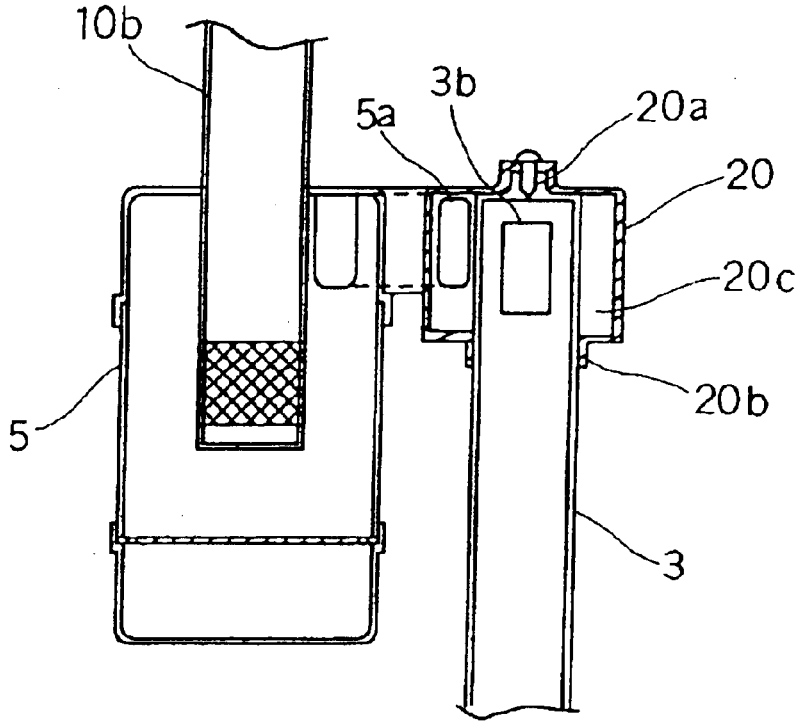
FIGS. 11(*a*) and 11(*b*) are diagrams showing another example of the structure of the suction air guide of the vacuum cleaner of the first embodiment of the invention.
Figure 11B:
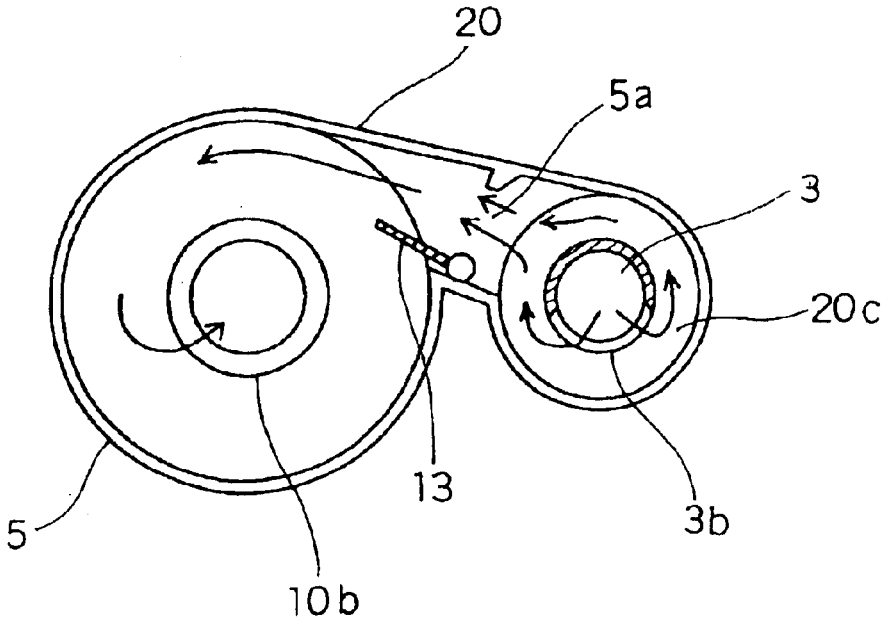

As shown in FIG. 11(*a*), in the suction air guide 20 provided in the cyclone dust collecting part 5, sliding parts 20*a* and 20*b* may be formed so that the connection pipe 3 is held rotatably and hermetically. This makes the cyclone dust collecting part 5 rotatable about the connection pipe 3. That is, it is possible to retreat the cyclone dust collecting part 5 into the desired position according to the place to be cleaned, for example near a wall, in a narrow space, etc. This enhances the operability of the vacuum cleaner.

An opening 3*b* is formed in the connection pipe 3, and a suction air passage 20*c* is formed around the outside of the connection pipe 3. Thus, as shown in FIG. 11(*b*), irrespective of the positions of the opening 3*b* and the flow-in port 5*a*, the suction air is sucked into the cyclone dust collecting part 5 through the suction air passage 20*c*. The suction air guide 20 may be provided with a stopper that engages with the connection pipe 3 so as to restrict the rotation angle of the cyclone dust collecting part 5.

Figure 12:
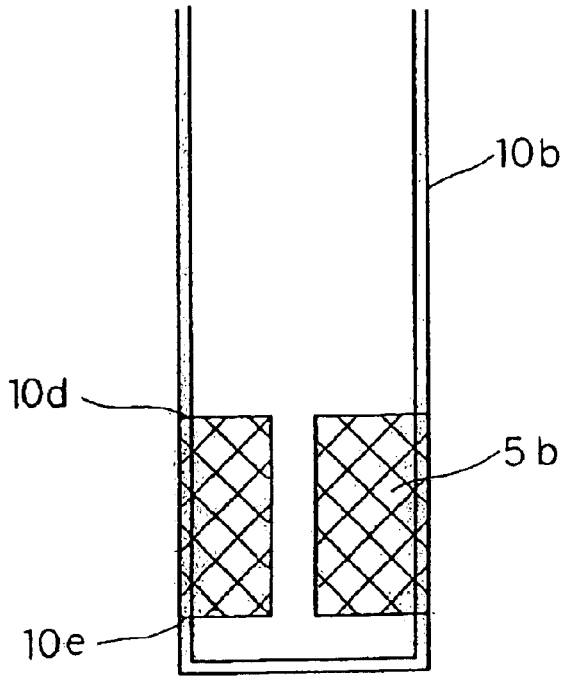
FIG. 12 is a diagram showing an example of the structure of the exhaust port of the cyclone dust collecting part of the vacuum cleaner of the first embodiment of the invention.

In FIGS. 2 and 3 described earlier, a coupling pipe 10*b*, which is integral with the coupling member 10, has the end surface 10*c* thereof closed and is put into the cyclone dust collecting part 5. In the outer peripheral surface of the coupling pipe 10*b*, an exhaust port 5*b*, through which the suction air is exhausted from the cyclone dust collecting part 5, is formed in a position lower than the flow-in port 5*a*. As shown in FIG. 12, the exhaust port 5*b* is formed as mesh having a large number of through holes.

The mesh is formed out of a resin such as a nylon-based resin and is fixed to the coupling pipe 10*b* by double molding, by heat fusion, or with adhesive in such a way as not to leave surface irregularities at the boundaries 10*d* and 10*e*. If there are surface irregularities there, dust is caught thereby and prompts clogging of the exhaust port 5*b*.

Figure 13:
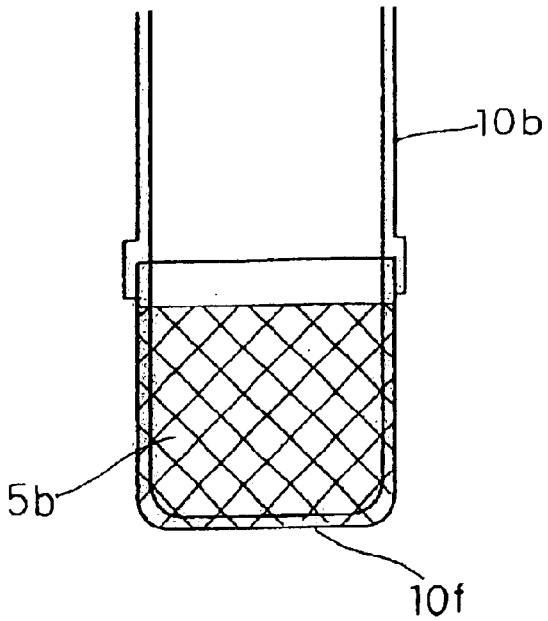
FIG. 13 is a diagram showing another example of the structure of the exhaust port of the cyclone dust collecting part of the vacuum cleaner of the first embodiment of the invention.

Alternatively, as shown in FIG. 13, the mesh may be formed into a lint tube 10*f*, which is then detachably fitted to the coupling pipe 10*b* by screw engagement, with a bayonet, with a clamp, or by another means. This is further preferable because it makes the repair and cleaning of the mesh easy.

The mesh of the exhaust port 5*b* is as fine as or finer than the mesh of the partition wall 9 so that the coarse particles of dust collected in the first dust collecting chamber 7 do not evade through the exhaust port 5*b*. Fine particles of dust are collected in the second dust collecting chamber 8, which is arranged outside the suction air passage away from the exhaust port 5*b*, and are thereby prevented from evading through the exhaust port 5*b*. The exhaust port 5*b* may be formed by molding the coupling pipe 10*b* or the lint tube 10*f* in the shape of a grid so as to form a large number of through holes that penetrate between the inside of the coupling pipe 10*b* and the first dust collecting chamber 7.

Figure 14:
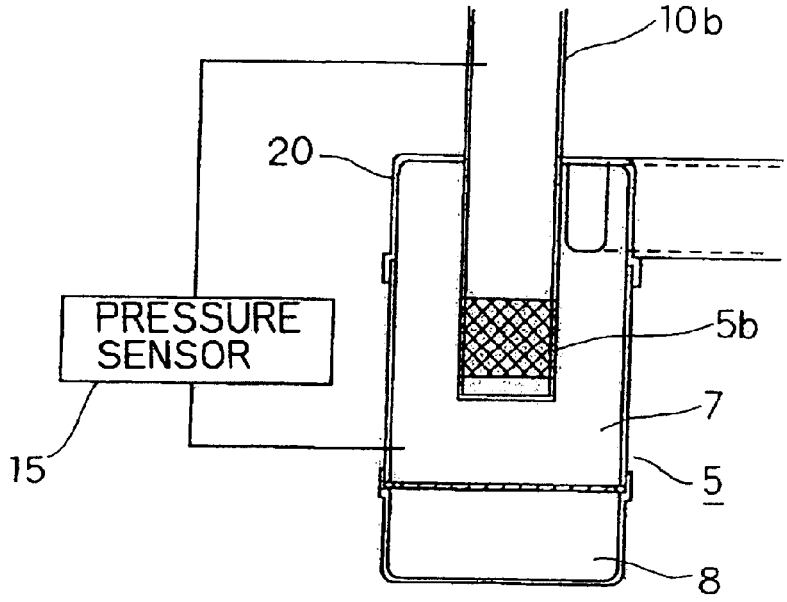
FIG. 14 is a diagram illustrating how the pressure sensor is fitted in the cyclone dust collecting part of the vacuum cleaner of the first embodiment of the invention.

As shown in FIG. 14, a pressure sensor 15 for detecting the pressure difference between inside the coupling pipe 10*b* and inside the first dust collecting chamber 7 may be provided. This makes it possible to detect the clogging of the exhaust port 5*b*. When the pressure sensor 15 detects a predetermined pressure difference, the electric blower 1*a* (see FIG. 1) is stopped, and the user is prompted to clean the exhaust port 5*b*. It is further preferable to provide a pressure difference warning means such as a lamp or an indicating means for giving a warning of the predetermined pressure difference on detection thereof. This makes it easier for the user to recognize the clogging of the exhaust port 5*b*.

In the cyclone dust collecting part 5 structured as described above, the suction air introduced through the flow-in port 5*a* passes through the first dust collecting chamber 7 in the form of a whirling stream, and meanwhile dust is separated therefrom. Fine particles of the dust pass through the opening part 9*a* and are collected in the second dust collecting chamber 8. Coarse particles are collected in the first dust collecting chamber 7. The suction air having dust removed therefrom passes through the first dust collecting chamber 7, and is then sucked through the exhaust port 5*b* into the electric blower 1*a* (see FIG. 1).

Thus, the suction air passage inside the cyclone dust collecting part 5 consists of the flow-in port 5*a*, the first dust collecting chamber 7, and the exhaust port 5*b*. That is, the first dust collecting chamber 7 for accommodating dust is arranged within the suction air passage. This helps miniaturize the cyclone dust collecting part 5. On the other hand, the second dust collecting chamber 8 is arranged outside the suction air passage. This prevents the fine particles of dust that are collected in the second dust collecting chamber 8 from flowing back into the suction air passage and evading through the cyclone dust collecting part 5.

Figure 15:
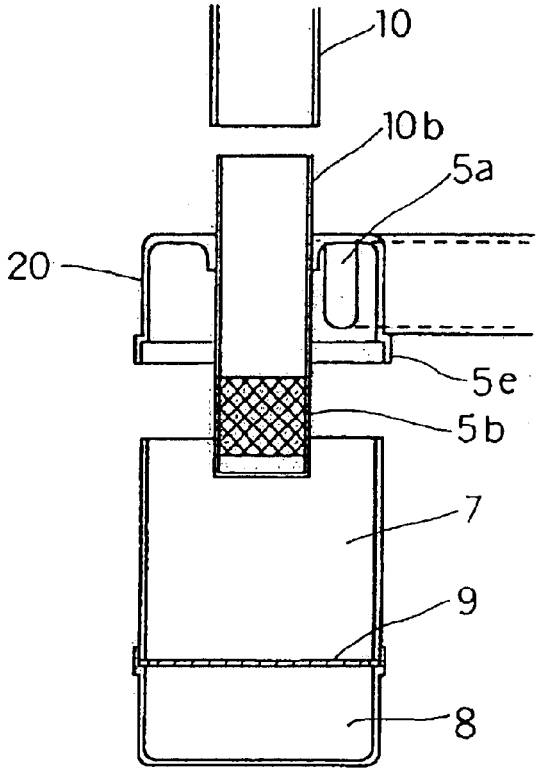
FIG. 15 is a diagram showing the first and second dust collecting chambers of the cyclone dust collecting part of the vacuum cleaner of the first embodiment of the invention, showing their detached state.
Figure 16:
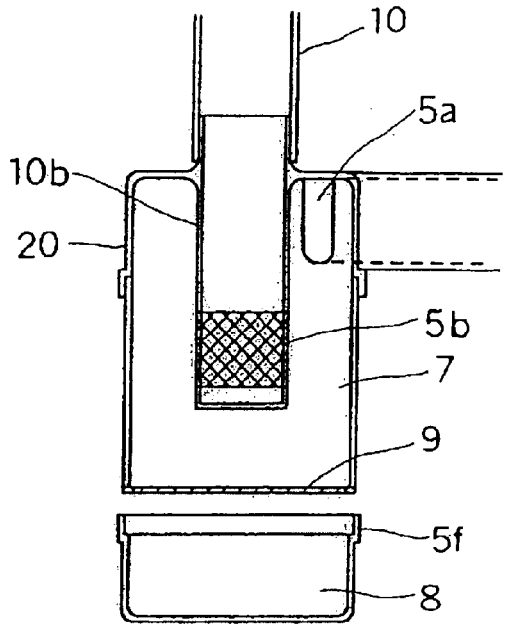
FIG. 16 is a diagram showing the first and second dust collecting chambers of the cyclone dust collecting part of the vacuum cleaner of the first embodiment of the invention, showing an example of their separated state.
Figure 17:
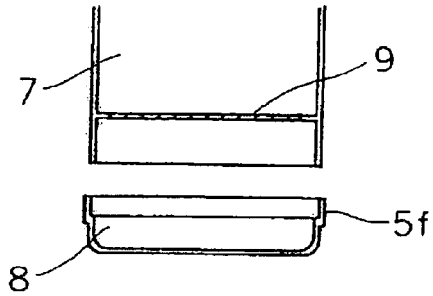
FIG. 17 is a diagram showing the first and second dust collecting chambers of the cyclone dust collecting part of the vacuum cleaner of the first embodiment of the invention, showing another example of their separated state.
Figure 18:
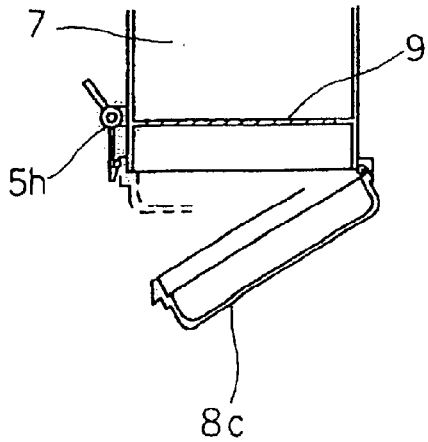
FIG. 18 is a diagram showing the second dust collecting chamber of the cyclone dust collecting part of the vacuum cleaner of the first embodiment of the invention, showing its state with the lid open.

Moreover, as shown in FIG. 15, the cyclone dust collecting part 5 is so structured that the first and second dust collecting chambers 7 and 8 are integrally detachable by means of a coupling part 5*e* realized by screw engagement, with a bayonet, with a clamp, or by another means. As shown in FIG. 16 or 17, the first and second dust collecting chambers 7 and 8 are further separable by means of a coupling part 5*f* realized by screw engagement, with a bayonet, with a clamp, or by another means. Furthermore, as shown in FIG. 18, the second dust collecting chamber 8 may be so structured that a lid 8*c* at its lid is openable by means of a coupling part 5*h* realized by screw engagement, with a bayonet, with a clamp, or by another means.

Thus, since fine particles of dust are collected in the second dust collecting chamber 8, it is possible to detach the first and second dust collecting chambers 7 and 8 integrally from the vacuum cleaner, and then separate the first and second dust collecting chambers 7 and 8 from each other above a trash can or the like. This makes it easy to move the vacuum cleaner around, and also helps prevent fine particles of dust from rising and making the surroundings dirty. Moreover, it is easy to perform cleaning using water or the like. Furthermore, the openable lid 8*c* makes the disposal of refuse easier.

In FIG. 15, the coupling member 10 and the coupling pipe 10*b*, and the coupling pipe 10*b* and the suction air guide 20, are detachably coupled together by means of a taper-taper joint. Alternatively, as shown in FIG. 16, the coupling pipe 10*b* and the suction air guide 20 may be formed integrally.

Figure 19:
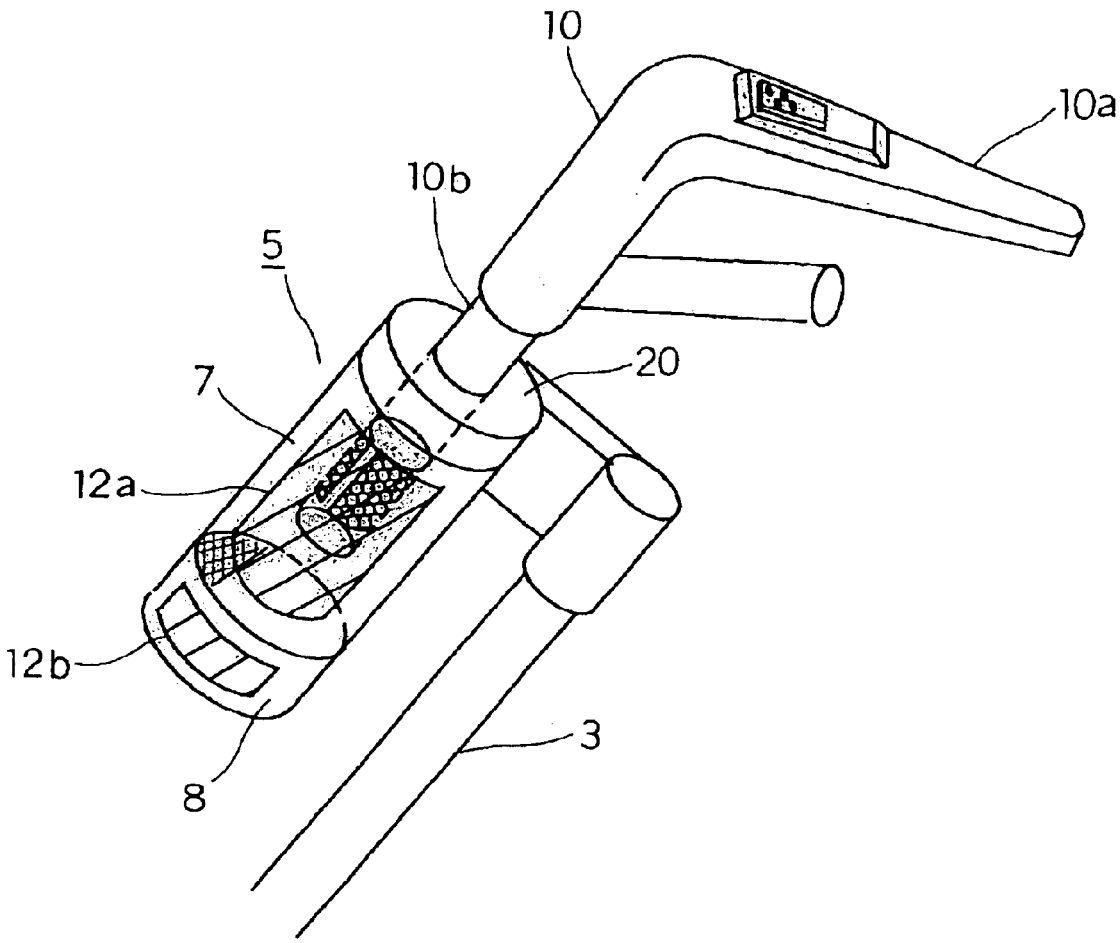
FIG. 19 is a diagram showing the first and second dust collecting chambers of the cyclone dust collecting part of the vacuum cleaner of the first embodiment of the invention, showing their state with the transparent member additionally provided.

As shown in FIG. 19, part or the whole of the first and second dust collecting chambers 7 and 8 may be formed out of a transparent or semitransparent member 12*a* and 12*b*. This permits the amount of dust collected in the first and second dust collecting chambers 7 and 8 to be visually checked, and thus makes it easier to recognize when to dispose of refuse. It is preferable to form the transparent members 12*a* and 12*b* out of glass, because then they are resistant to scratches and continue to offer good viewability for an extended period.

Figure 20A:
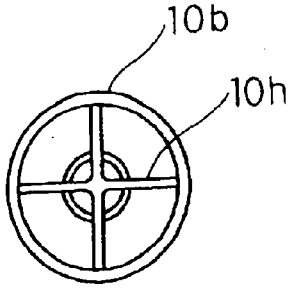
FIGS. 20(*a*), 20(*b*), and 20(*c*) are diagrams showing the exhaust port of the cyclone dust collecting part of the vacuum cleaner of a second embodiment of the invention.
Figure 20B:
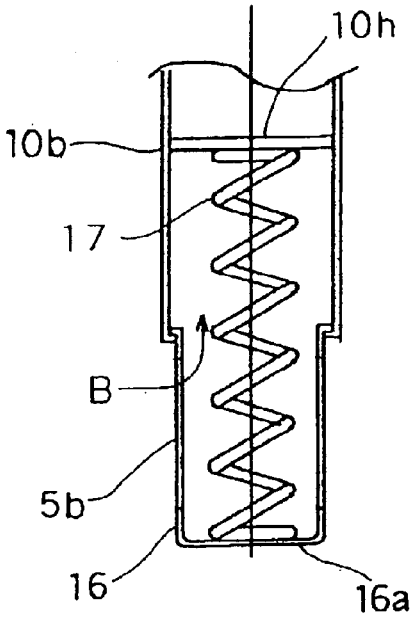
Figure 20C:
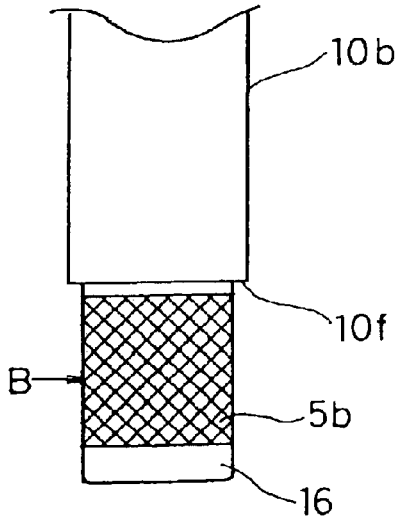

FIGS. 20(*a*), 20(*b*), and 20(*c*) are a sectional view as seen from above, a sectional view as seen from the side, and a side view of the exhaust port 5*b* of the cyclone dust collecting part 5 of the vacuum cleaner of a second embodiment. In other respects, the structure here is the same as in the first embodiment. In this embodiment, the coupling pipe 10*b* has its end surface 10*f* open, and functions as an outer cylinder into which an inner cylinder 16 is slidably fitted.

Inside the coupling pipe 10*b*, a cross-shaped spring support 10*h* is formed. Between the spring support 10*h* and the bottom surface 16*a* of the inner cylinder 16, a compressed spring 17 is provided that loads the inner cylinder 16 with a force that tends to press it downward. In the outer peripheral surface of the inner cylinder 16 is provided an exhaust port 5*b* similar to that shown in FIG. 12.

Figure 21A:
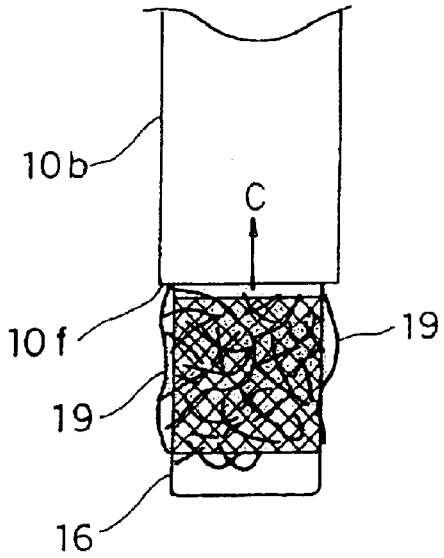
FIGS. 21(*a*) and 21(*b*) are diagrams illustrating the movement of the exhaust port of the cyclone dust collecting part of the vacuum cleaner of the second embodiment of the invention.
Figure 21B:
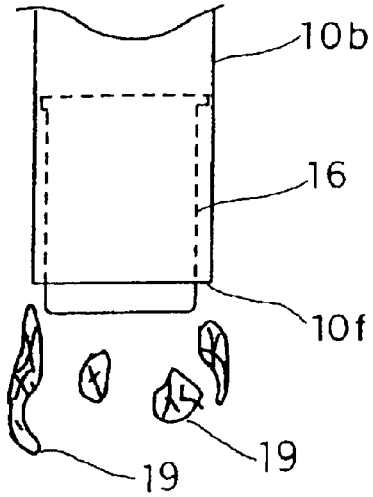

The suction air flows through the exhaust port 5*b* into the inner cylinder 16 as indicated by arrow B, and is sucked through the coupling pipe 10*b* into the electric blower 1*a* (see FIG. 1). As shown in FIG. 21(*a*), when refuse 19 attaches to and clogs the exhaust port 5*b*, the vacuum pressure of the electric blower 1*a* sucks the inner cylinder 16 in as indicated by arrow C. As a result, as shown in FIG. 21(*b*), the inner cylinder 16 retracts into the coupling pipe 10*b* (outer cylinder), and the exhaust port 5*b* is covered by the coupling pipe 10*b*. Meanwhile, the end surface 10*f* of the coupling pipe 10*b* scrapes the refuse 19 off.

Inside the inner cylinder 16, a switch member (not shown) for detecting the movement of the inner cylinder 16 is provided. When the inner cylinder 16 moves, it turns the switch member on so that a warning is given of the clogging of the exhaust port 5*b* by a clogging warning means such as by lighting an LED or displaying an indication on a liquid crystal display panel.

Warned of the clogging of the exhaust port 5*b* by the clogging warning means, the user stops the electric blower 1*a* and cleans the exhaust port 5*b*. Since the refuse 19 is scraped off by the movement of the inner cylinder 16, it is also possible to stop the electric blower 1*a* temporarily as soon as the switch member is turned on, so that the exhaust port 5*b* is exposed by the resilience of the compressed spring 17, and then immediately restart the electric blower 1*a*.

As in FIG. 14 described earlier, a pressure sensor 15 may be provided between the coupling pipe 10*b* and the first dust collecting chamber 7. When the exhaust port 5*b* is clogged and the inner cylinder 16 retracts into the coupling pipe 10*b*, the pressure sensor 15 detects a predetermined pressure difference. Here, it is also possible to stop the electric blower 1*a* (see FIG. 1) and then restart it a predetermined time thereafter.

Now, the exhaust port 5*b* has been cleaned as a result of the refuse 19 attached to the exhaust port 5*b* being scraped off by the end surface 10*f* of the coupling pipe 10*b*, and the inner cylinder 16 has returned to its original position under the resilience of the compressed spring 17 as a result of the electric blower 1*a* being stopped. Thus, it is possible to restart the electric blower 1*a*. If the restarting of the electric blower 1*a* is attempted several times within a predetermined time and nevertheless the pressure difference does not drop, the exhaust port 5*b* may be recognized as insufficiently cleaned so that the electric blower 1*a* is stopped but not restarted.

Figure 22:
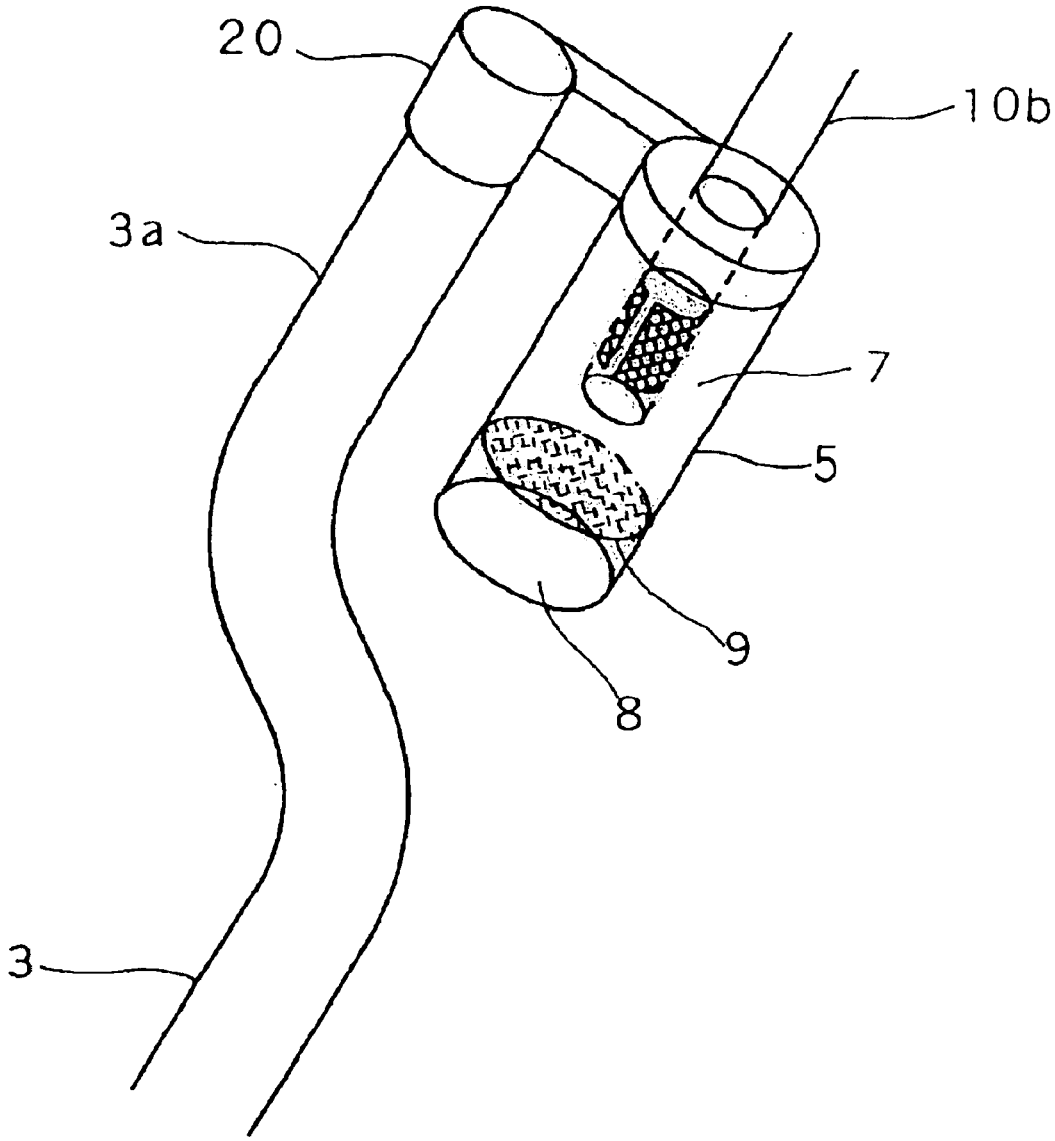
FIG. 22 is a perspective view of the cyclone dust collecting part of the vacuum cleaner of a third embodiment of the invention.

FIG. 22 is a perspective view of the cyclone dust collecting part 5 of the vacuum cleaner of a third embodiment. For convenience's sake, such members as find their counterparts in the first embodiment shown in FIG. 2 are identified with the same reference numerals. In other respects, the structure here is the same as in the first embodiment. In this embodiment, the cyclone dust collecting part 5 is arranged substantially parallel to the connection pipe 3, and the connection pipe 3 is bent and coupled to the cyclone dust collecting part 5. The bent portion functions as a handle 3*a* that is held by the user during cleaning.

With this structure, not only the same effects as in the first and second embodiments are achieved, but it is also possible to reduce the space occupied by the handle 10*a* (see FIG. 1). Thus, it is possible to miniaturize the vacuum cleaner and enhance the operability thereof.

Figure 23:
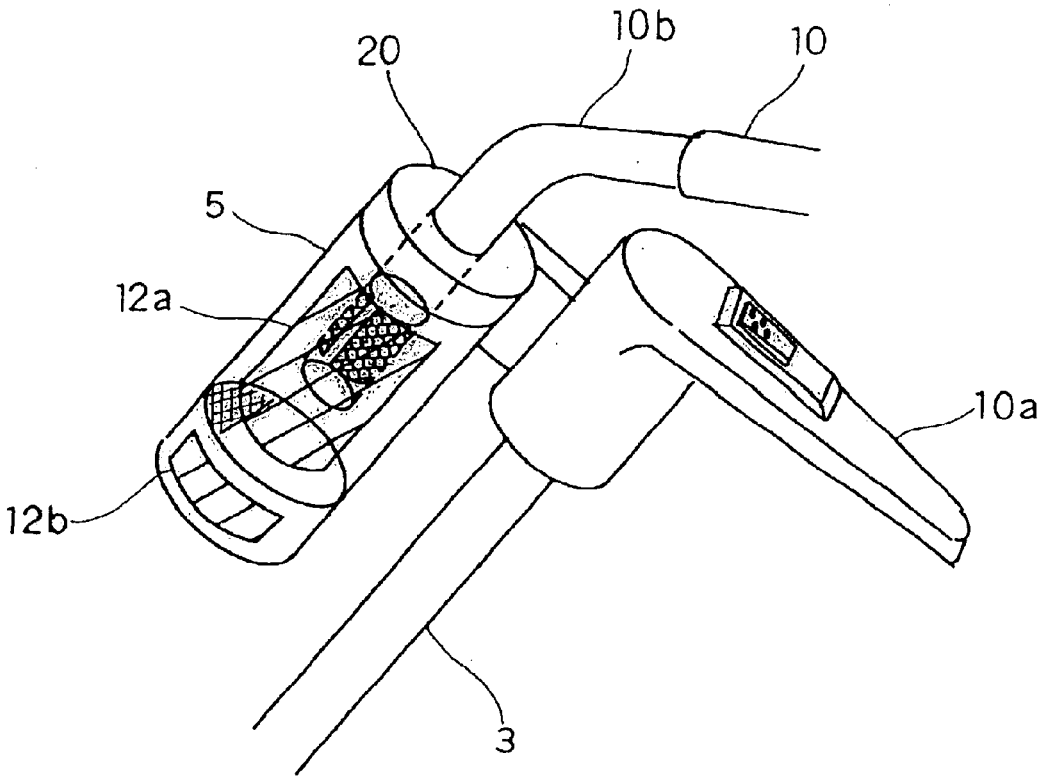
FIG. 23 is a perspective view of an example of the cyclone dust collecting part and the handle of the vacuum cleaner of a fourth embodiment of the invention.

FIG. 23 is a perspective view of the cyclone dust collecting part 5 and the handle portion of the vacuum cleaner of a fourth embodiment. For convenience's sake, such members as find their counterparts in the first embodiment shown in FIG. 2 are identified with the same reference numerals. In other respects, the structure here is the same as in the first embodiment. In this embodiment, the handle 10*a* held by the user is formed integrally with the suction air guide 20 of the cyclone dust collecting part 5.

Figure 24:
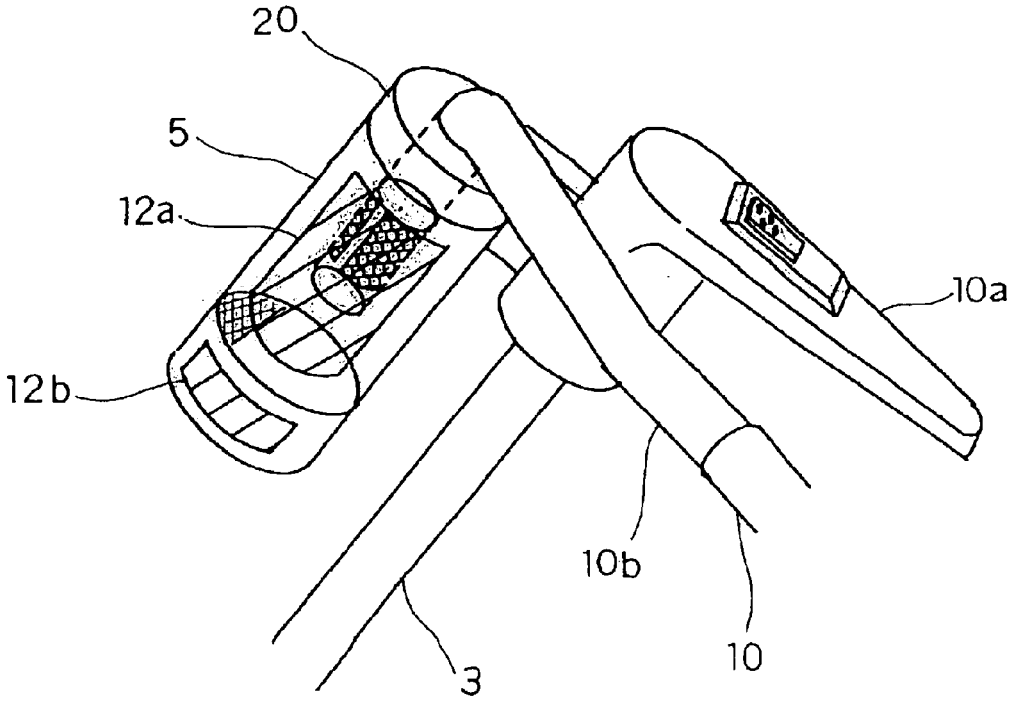
FIG. 24 is a perspective view of another example of the cyclone dust collecting part of the vacuum cleaner of the fourth embodiment of the invention.

Moreover, the coupling pipe 10*b* put into the cyclone dust collecting part 5 is connected, through a coupling part 10, to a suction hose 2 (see FIG. 1) so that the suction air is introduced into the electric blower 1*a*. In the vacuum cleaner structured in this way also, it is possible to structure the cyclone dust collecting part 5 in the same manner as in the first and second embodiments, and thereby achieve the same effects. As shown in FIG. 24, the coupling pipe 10*b* and the suction air guide 20 may be formed integrally.

Figure 25:
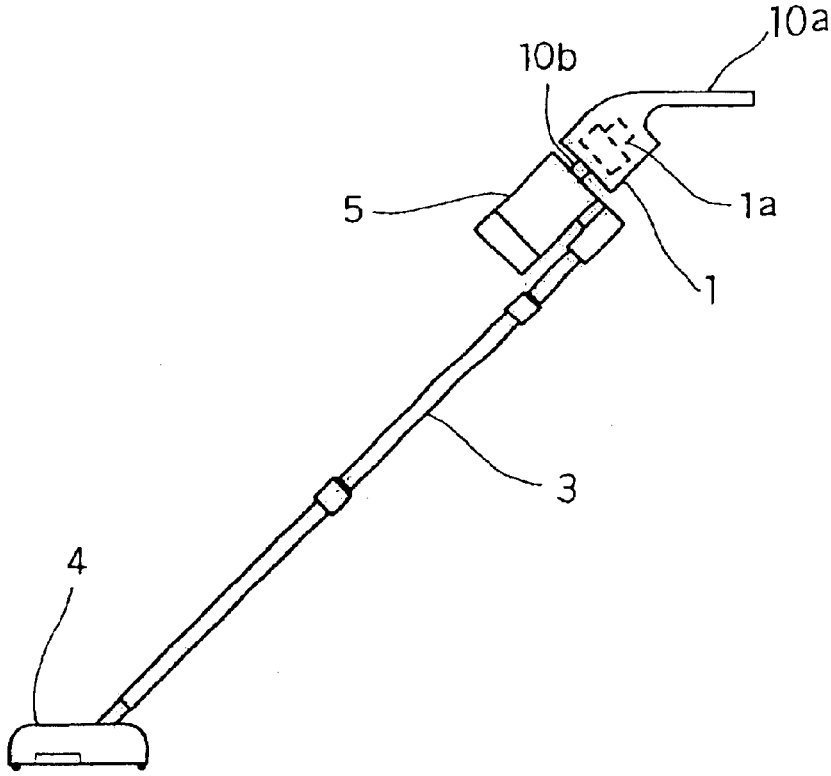
FIG. 25 is a diagram schematically showing the vacuum cleaner of a fifth embodiment of the invention.
Figure 26:
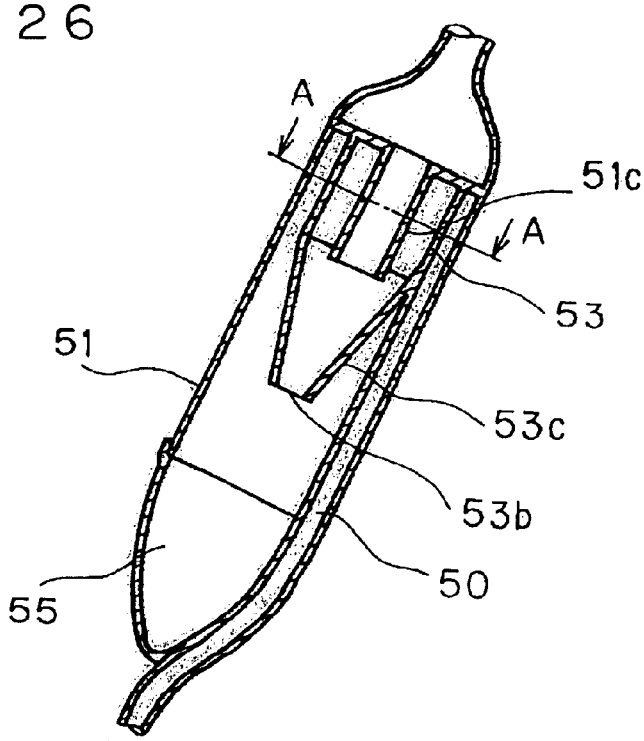
FIG. 26 is a sectional view, as seen from the side, of the cyclone dust collecting part of a conventional vacuum cleaner.
Figure 27:
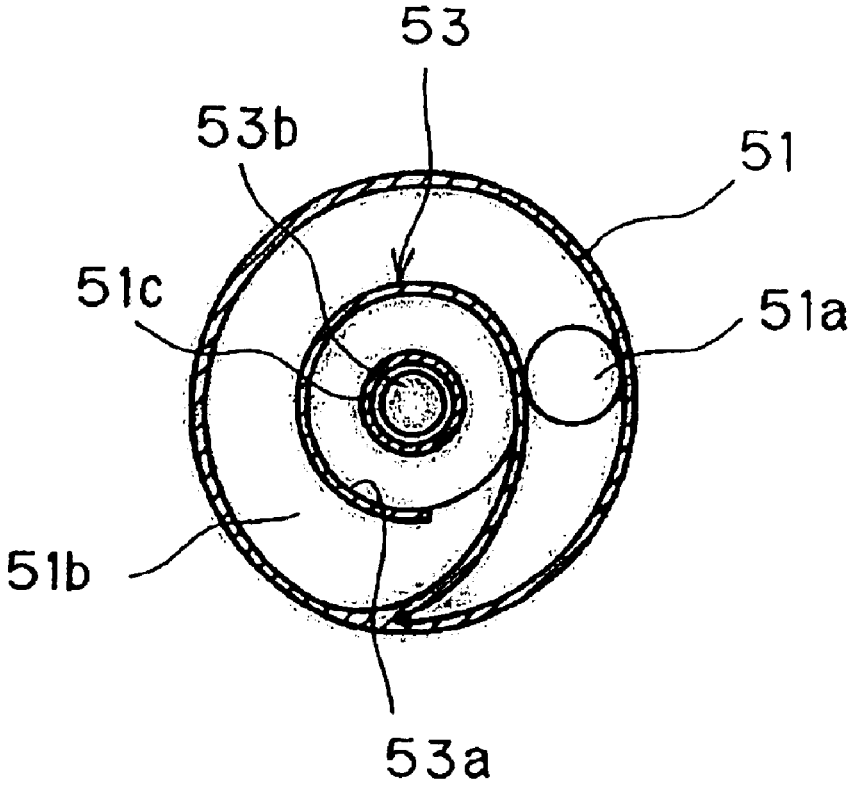
FIG. 27 is a sectional view taken along A—A shown in FIG. 26.

FIG. 25 is a diagram schematically showing the vacuum cleaner of a fifth embodiment. For convenience's sake, such members as find their counterparts in the first embodiment shown in FIG. 2 are identified with the same reference numerals. In this embodiment, the coupling pipe 10*b* coupled to the cyclone dust collecting part 5 is directly coupled to the body 1; that is, the vacuum cleaner as a whole is structured as a vacuum cleaner of a so-called upright type. The handle 10*a* held by the user during cleaning is formed integrally with the body 1. In the vacuum cleaner structured in this way also, it is possible to structure the cyclone dust collecting part 5 in the same manner as in the first and second embodiments, and thereby achieve the same effects.

INDUSTRIAL APPLICABILITY

As described above, according to the present invention, by arranging a dust collecting chamber for collecting dust within a suction air passage, it is possible to miniaturize a cyclone dust collecting part and thereby enhance the operability of a vacuum cleaner.

Moreover, according to the present invention, by arranging a first and a second dust collecting chamber inside a cyclone dust collecting part with a partition wall, having mesh or the like, placed between them, it is possible to separate dust according to particle size or weight. This makes it possible to prevent fine particles of dust from being exposed on a surface when the first dust collecting chamber is detached from the cyclone dust collecting part. Thus, it is possible to prevent fine particles of dust from rising when refuse is disposed of.

Moreover, according to the present invention, arranging a first dust collecting chamber inside a suction air passage helps miniaturize a cyclone dust collecting part, and arranging a second dust collecting chamber outside helps prevent the dust collected in the second dust collecting chamber from flowing back into the suction air passage and evading through an exhaust port.

Moreover, according to the present invention, a first and a second dust collecting chamber can be detached integrally, and the first and second dust collecting chambers can be separated from each other above a trash can or the like. This makes it easy to move around a vacuum cleaner, and in addition helps prevent the fine particles of dust collected in the second dust collecting chamber from rising up and making the surroundings dirty. Moreover, it is easy to perform cleaning using water or the like. Moreover, by forming part or the whole of the first and second dust collecting chambers out of a transparent member, it is possible to visually check the amount of dust. This makes it easy to recognize when to dispose of refuse.

Moreover, according to the present invention, a valve is provided that closes an flow-in port when suction air is not flowing. This prevents backflow and release of dust through a connection pipe as when a vacuum cleaner is stored away.

Moreover, according to the present invention, a pressure sensor that detects the pressure difference between on the upstream and downstream sides of an exhaust port of a cyclones dust collecting part, or an inner cylinder that is slidable under the suction force of an electric blower is provided. This makes it easy to detect clogging of the exhaust port.

Moreover, according to the present invention, when an opening part is formed in part of a partition wall, the opening part is arranged on the side of a connection pipe opposite to a floor surface. This prevents backflow of dust through the opening part when a high position such as the surface of a wall is cleaned, and thus helps enhance the operability of a vacuum cleaner.

Moreover, according to the present invention, a connection pipe is bent so as to function as a handle held by the user during cl. This helps reduce the space occupied by the handle. In this way, it is possible to miniaturize a vacuum cleaner and enhance the operability thereof.

What is claimed is:

1. A vacuum cleaner comprising a suction port body having a suction port, an electric blower for generating suction air, a connection pipe connected to the suction port body, and a cyclone type dust collecting part, disposed between the suction port body and the electric blower, for separating dust by forming the introduced suction air into a whirling stream and collecting the separated dust in a dust collecting chamber arranged in a suction air passage, wherein a suction air guide is provided that comprises a cylindrical portion substantially cylindrical in shape which is fitted on a top portion of the dust collecting chamber and which has an exhaust portion formed so as to protrude from a center of a ceiling surface thereof into the dust collecting chamber, said exhaust portion being arranged substantially perpendicularly to the flow-in portion and a filter is provided in an exhaust port formed in a peripheral surface of the exhaust portion, a connecting portion connected to the connection pipe, and a flow-in portion that couples the cylindrical portion and the connecting portion together so as to permit dust to be introduced tangentially to the dust collecting chamber.

2. A vacuum cleaner comprising a suction port body having a suction port, an electric blower for generating suction air, a connection pipe connected to the suction port body, and a cyclone type dust collecting part, disposed between the suction port body and the electric blower, for forming the suction air introduced through a flow-in port into a whirling stream so as to separate dust and then discharging the suction air through an exhaust port, wherein the cyclone type dust collecting part has a first dust collecting chamber and a second dust collecting chamber, both cylindrical in shape, for accommodating the separated dust, the first and second dust collecting chambers being arranged side by side along an axis thereof and separated from each other by a partition wall having an opening part formed therein.

3. A vacuum cleaner as claimed in claim 2, wherein a suction air guide is provided that comprises a cylindrical portion substantially cylindrical in shape which is fitted on a top portion of the first dust collecting chamber and which has an exhaust portion formed so as to protrude from a center of a ceiling surface thereof into the first dust collecting chamber, a connoting portion that is connected to the connection pipe, and a flow-in portion that couples the cylindrical portion and the connecting portion together so as to permit dust to be introduced tangentially to the first dust collecting chamber.

4. A vacuum cleaner as claimed in claim 3, wherein the first dust collecting chamber is arranged within a suction air passage of the cyclone type dust collecting part, and the second dust collecting chamber is arranged outside the suction air passage of the cyclone type dust collecting part.

5. A vacuum cleaner as claimed in claim 3, wherein the first and second dust collecting chambers are arranged so as to be detachable from the cyclone type dust collecting part.

6. A vacuum cleaner as claimed in claim 3, wherein at least part of the first and second dust collecting chambers is formed out of a transparent member that permits an inside to be viewed from outside.

7. A vacuum cleaner as claimed in claim 3, wherein a valve for closing the flow-in port when the electric blower is at rest is provided.

8. A vacuum cleaner as claimed in claim 3, wherein the exhaust portion is arranged substantially perpendicularly to the flow-in portion, and a filter is provided in the exhaust port formed in a peripheral surface of the exhaust portion.

9. A vacuum cleaner as claimed in claim 3, wherein the exhaust port is provided in a cylindrical surface of an inner cylinder that is slidable inside an outer cylinder that is provided so as to protrude into the first dust collecting chamber, and, when the exhaust port is clogged, the exhaust port is covered by the outer cylinder under a suction force of the electric blower.

10. A vacuum cleaner as claimed in claim 3, wherein a pressure sensor for detecting a pressure difference between in a suction air passage of the cyclone type dust collecting part and in an exhaust passage for the suction air exhausted through the exhaust port is provided.

11. A vacuum cleaner as claimed in claim 3, wherein the cyclone type dust collecting part is arranged substantially parallel to the connection pipe and on a side of the connection pipe opposite to a floor surface, and the opening part is provided away from the connecting pipe.

12. A vacuum cleaner as claimed in claim 3, wherein the cyclone type dust collecting part is arranged substantially parallel to the connecting pipe, and part of the connection pipe is bent so as to form a handle part to be held by a user during cleaning.

13. A vacuum cleaner as claimed in claim 3, wherein the electric blower and the cyclone type dust collecting part are so arranged as to communicate with each other through a flexible communicating pipe.

14. The vacuum cleaner as claimed in claim 2, wherein, at the opening part of the partition wall, a rib is formed so as to prevent backflow to the dust collected in the second dust collecting chamber.

15. The vacuum cleaner as claimed in claim 2, wherein the first and second dust collecting chambers are separable from each other.

16. The vacuum cleaner as claimed in claim 2, wherein a bottom part of the second dust collecting chamber is formed into an openable lid.

17. A vacuum cleaner comprising a suction port body having a suction port, an electric blower for generating suction air, a connection pipe connected to the suction port body, and a cyclone type dust collecting part, disposed between the suction port body and the electric blower, for separating dust by forming the introduced suction air into a whirling stream and collecting the separated dust in a dust collecting chamber arranged in a suction air passage, said cyclone type dust collecting part being arranged substantially parallel to the connection pipe, and part of the connection pipe being bent so as to form a handle part that runs along a peripheral surface of the cyclone type dust collecting part with a gap secured inbetween that permits insertion of fingers of a user, wherein a suction air guide is provided that comprises a cylindrical portion substantially cylindrical in shape which is fitted on a top portion of the dust collecting chamber and which has an exhaust portion formed so as to protrude from a center of a ceiling surface thereof into the dust collecting chamber, a connecting portion connected to the connection pipe, and a flow-in portion that couples the cylindrical portion and the connecting portion together so as to permit dust to be introduced tangentially to the dust collecting chamber.

18. A vacuum cleaner comprising a suction port body having a suction port, an electric blower for generating suction air, a connection pipe connected to the suction port body, and a cyclone type dust collecting part, disposed between the suction port body and the electric blower, for separating dust by forming the introduced suction air into a whirling stream and collecting the separated dust in a dust collecting chamber arranged in a suction air passage, said electric blower and said cyclone type dust collecting part being arranged as to communicate with each other through a flexible communicating pipe, wherein a suction air guide is provided that comprises a cylindrical portion substantially cylindrical in shape which is fitted on a top portion of the dust collecting chamber and which has an exhaust portion formed so as to protrude from a center of a ceiling surface thereof into the dust collecting chamber, a connecting portion connected to the connection pipe, and a flow-in portion that couples the cylindrical portion and the connecting portion together so as to permit dust to be introduced tangentially to the dust collecting chamber.

* * * * *